United States Patent [19]

Edwards

[11] 4,337,921

[45] Jul. 6, 1982

[54] INFLATABLE RAM

[75] Inventor: Thomas P. Edwards, Fareham, England

[73] Assignee: FPT Industries, Portsmouth, England

[21] Appl. No.: 171,089

[22] Filed: Jul. 22, 1980

[30] Foreign Application Priority Data

Jul. 30, 1979 [GB] United Kingdom ..... 7926502

[51] Int. Cl.[3] ..... B66F 3/24

[52] U.S. Cl. ..... 254/93 HP

[58] Field of Search ..... 92/42, 43, 44; 254/93 HP; 9/11 R, 11 A, 14, 30, 32, 33; 244/DIG. 2

[56] References Cited

FOREIGN PATENT DOCUMENTS

| | | | |
|---|---|---|---|
| 2628029 | 12/1977 | Fed. Rep. of Germany | 254/93 HP |
| 1072884 | 6/1967 | United Kingdom | 254/93 HP |
| 1816473 | 6/1970 | United Kingdom | 254/93 HP |
| 1456399 | 11/1976 | United Kingdom | 254/93 HP |

*Primary Examiner*—Robert C. Watson

*Attorney, Agent, or Firm*—Larson and Taylor

[57] ABSTRACT

An inflatable ram has an extensible wall of flexible sheet material connecting two opposed end faces to enclose a space which is divided into a plurality of interconnected compartments by diaphragms extending between opposed regions of the inner surface of the extensible wall so as to be parallel with the end faces. Restraining means, which may comprise elastic cords, are arranged to provide increasing restraint against inflation of successive compartments so that extension of the ram takes place by sequential inflation of the compartments as the restraining means are progressively overcome.

8 Claims, 6 Drawing Figures

INFLATABLE RAM

This invention relates to an inflatable ram having an extensible wall formed by flexible impermeable sheet material.

An inflatable ram having an extensible wall formed from flexible impermeable sheet material so as to be of bellows-like configuration may become unstable during extension of the ram through a long stroke. If the ram is designed to have a number of components, all of which attempt to inflate simultaneously, a long tube with convoluted sides is formed, that is a tube already buckled. The application of further end loading collapses the bellows and the ram becomes unstable.

It is an object of the present invention to provide an inflatable ram that will remain stable during extension through a long stroke.

According to the invention an inflatable ram comprises an extensible wall of flexible sheet material connecting two opposed end faces to enclose a space and permit the distance between the end faces to vary, a plurality of diaphragms dividing said closed spaces into interconnected compartments, and means arranged to provide increasing restraint against inflation of successive compartments so that in operation when the ram extends the compartments are inflated in sequence as the restraining means are progressively overcome.

One form of inflatable ram in accordance with the invention has separate restraining means provided for each individual compartment, and these restraining means may be of progressively increasing restraining power from one end of the ram to the other or, alternatively, they may be of equal restraining power and each restraining means may be arranged to be active on each of the compartments between it and one end of the ram.

Preferably the restraining means comprise elastic cords.

In an embodiment of the invention the flexible wall is arranged to collapse inwardly about each diaphragm to form a plurality of folds, each fold being restrained by an elastic restraining cord against movement away from a fixed one of said ram end faces which is attached to a rigid base member. In this embodiment the elastic cords apply restraint to the fold around which they pass, and also to all of the folds that are between that fold and the fixed end face of the ram. As each fold pulls out of its elastic restraining cords, so these restraining cords slip onto the underlying folds and provide increasing restraint against inflation of successive compartments so that the ram extends by sequential inflation of the compartments from one end face of the ram to the other.

In another embodiment of the invention in which the flexible wall is arranged to collapse inwardly about each diaphragm to form a plurality of folds when the ram is retracted, elastic restraining cords encircle the individual compartments between the diaphragms and the elastic cords are arranged to be of increasing restraining power from one end of the ram to the other.

A fixed end face of the ram may be attached to a rigid member. In an embodiment of the invention the rigid member comprises a dished plate and the extensible wall is housed substantially within said dished plate when the ram is retracted. The dished plate may be formed by a metal pressing, or a plastics or glass fibre moulding.

The extensible wall may be manufactured from flexible plastics sheet material or elastomeric sheet material, such as neoprene or natural rubber, which may be reinforced with nylon fabric.

Pressurised fluid for ram inflation may be supplied by way of a suitable tapping adapted for the attachment of a conduit from a source of pressurized gas, or for the attachment of a pressurised gas container, e.g. a pressurised air bottle.

An embodiment of the invention will now be described, by way of example, with reference to the accompanying drawings, in which.

Figure 1:
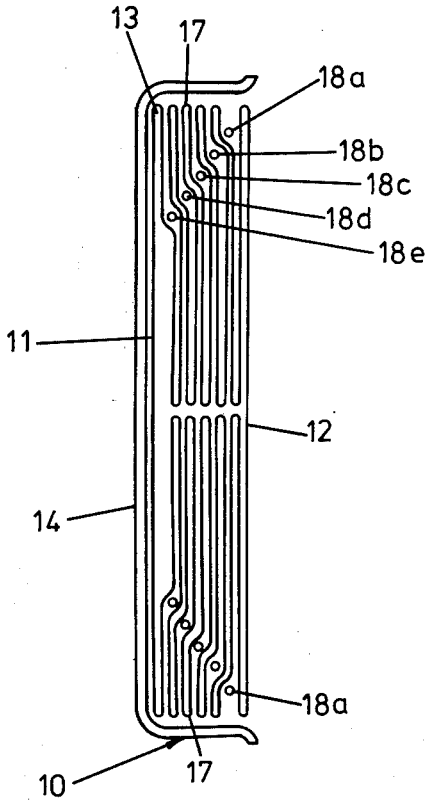
FIG. 1 is a transverse cross-section through an inflatable ram when retracted, and with internal diaphragms omitted for the sake of clarity.

An inflatable ram 10 comprises two opposed end faces 11 and 12, respectively, formed integrally with an extensible wall 13 so as to enclose a space into which pressurised fluid, for example air, may be introduced to vary the distance between the end face 11 which is fixed, and end face 12 which is movable. The extensible wall 13 and the end faces 11 and 12 are manufactured from elastomeric sheet material, for example neoprene or natural rubber, which is reinforced by a woven nylon fabric. The fixed end face 11 is attached, for example, by bonding, to a rigid member, in this embodiment a dished plate 14 formed as a light alloy pressing or a plastics moulding. With the ram in a retracted position, as shown in FIG. 1, the extensible wall 13 is housed substantially within the dished plate 14.

Figure 2:
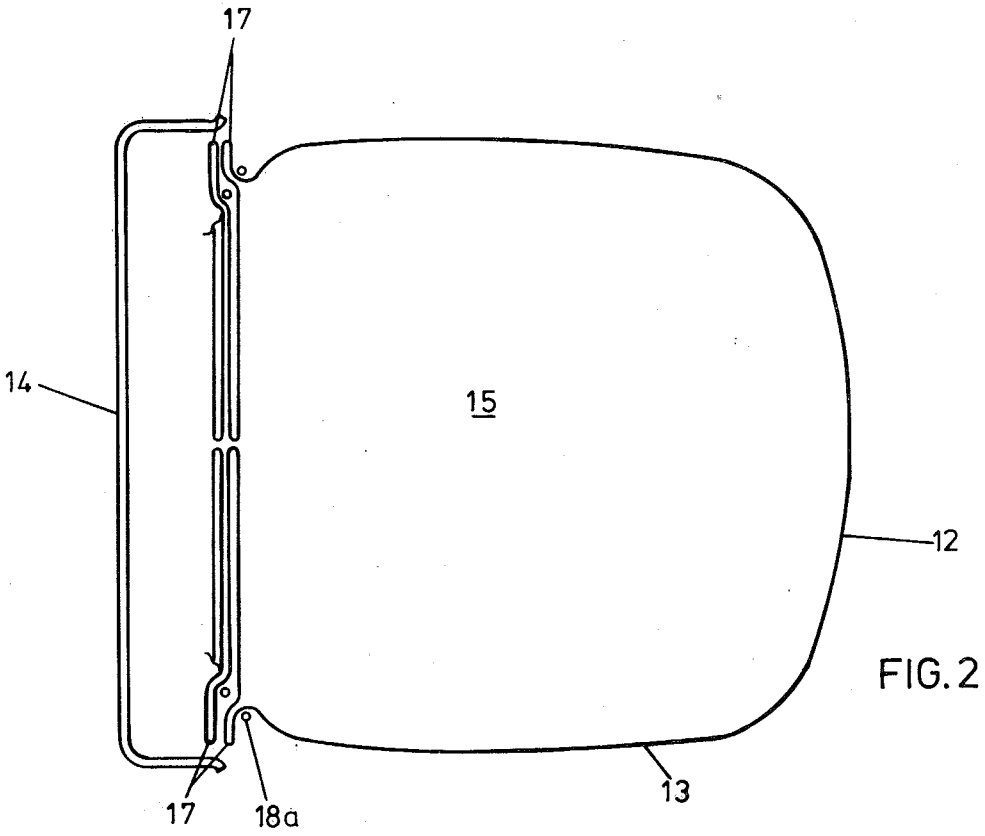
FIG. 2 is a similar section to FIG. 1 but with the ram commencing to extend.
Figure 3:
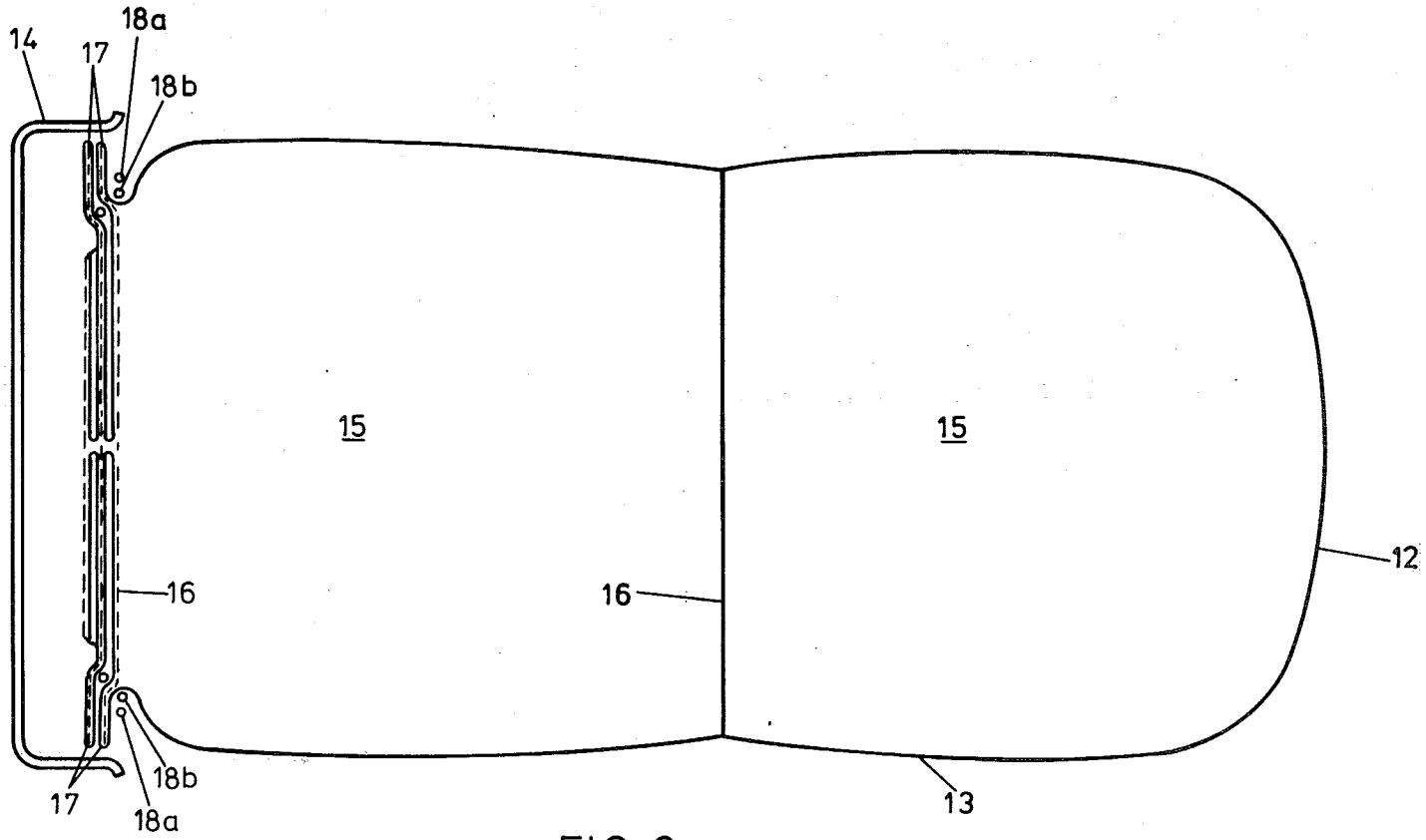
FIG. 3 is a view similar to FIG. 2 but with the ram further extended.
Figure 4:
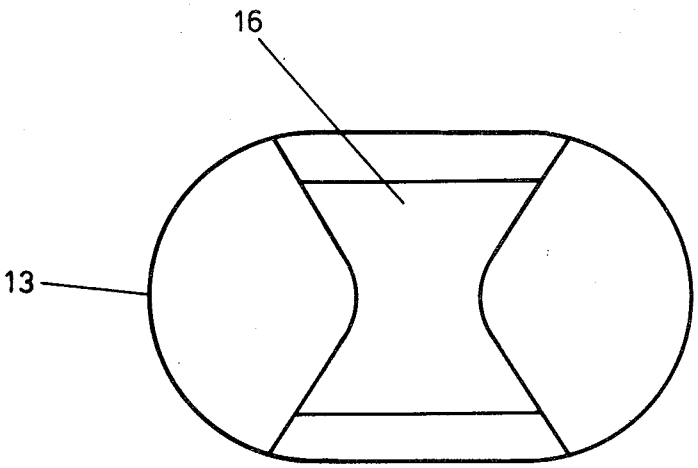
FIG. 4 is a transverse cross-section through an extensible wall of the ram illustrated in FIGS. 1, 2 and 3, and shows an internal diaphragm.
Figure 5:
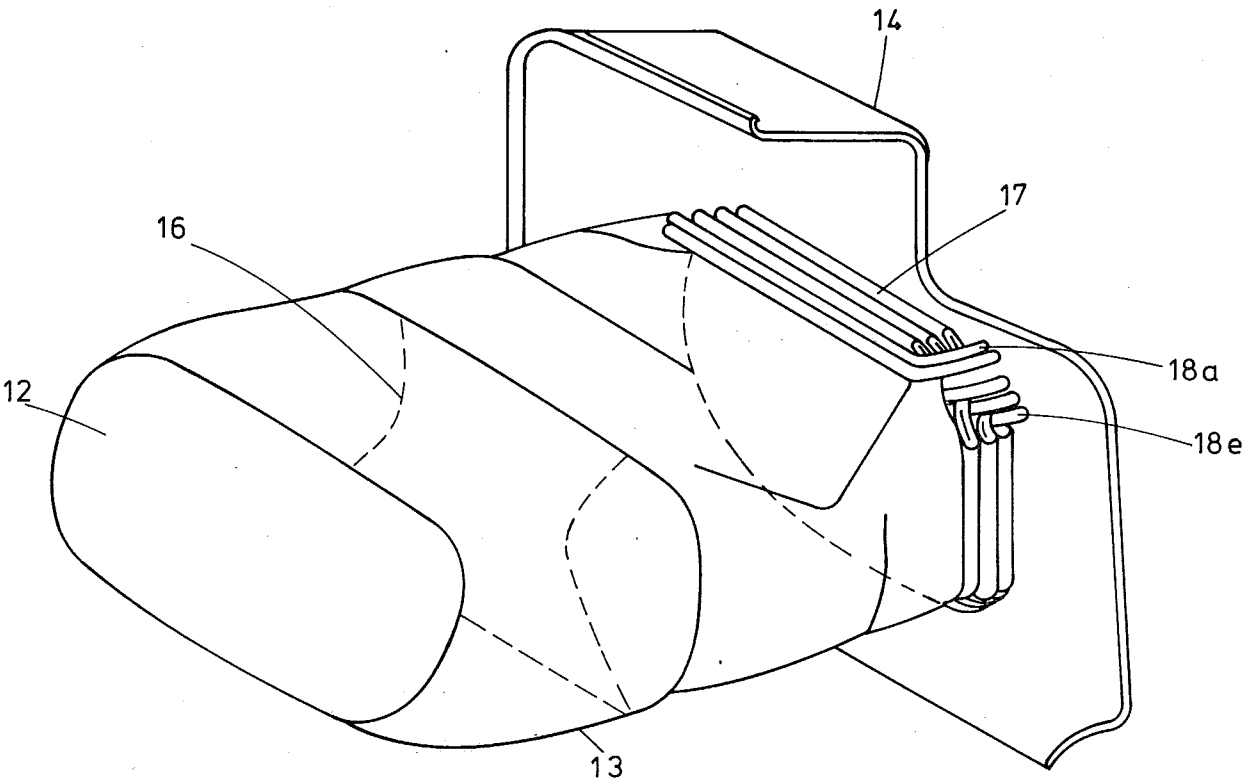
FIG. 5 is a partly sectioned pictorial view of the ram in a semi-extended position.
Figure 6:
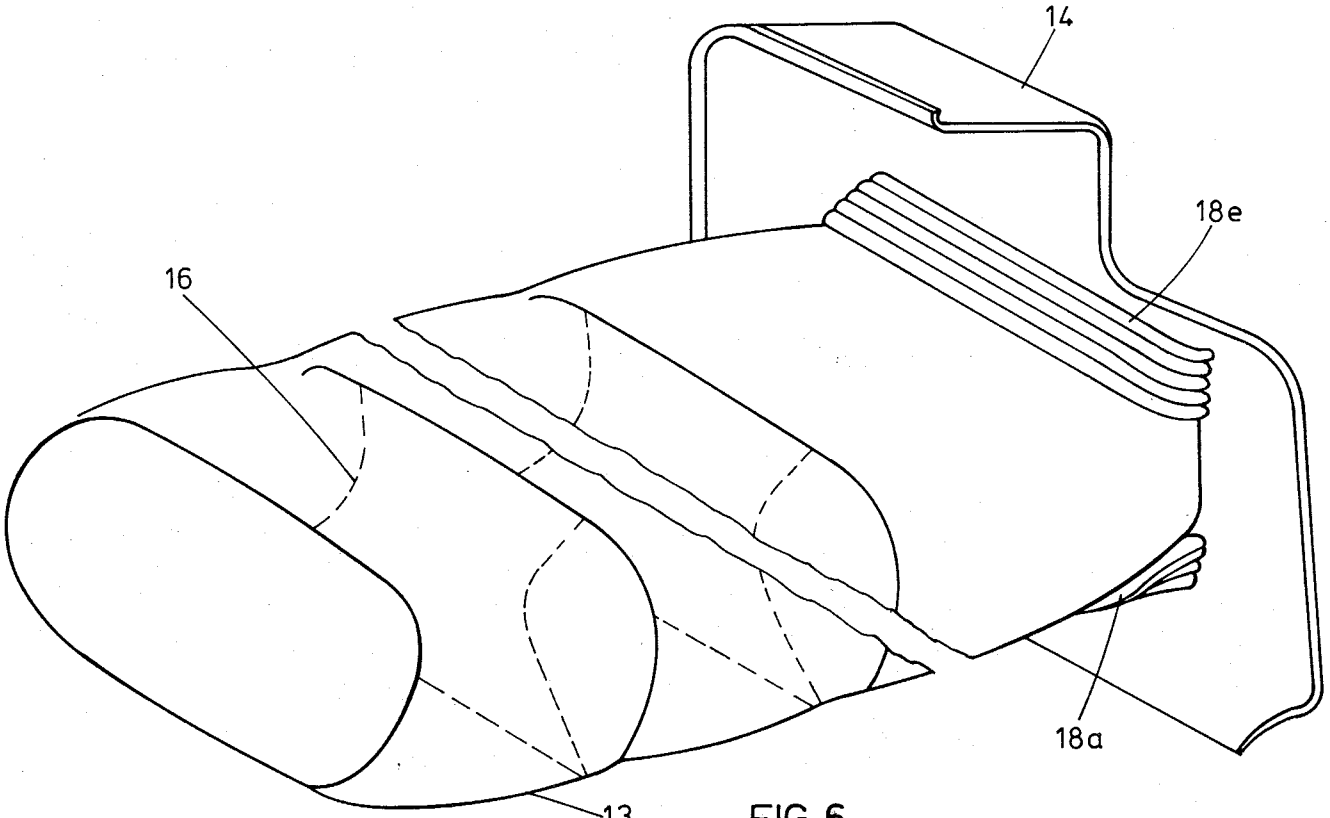
FIG. 6 is a similar view to that of FIG. 5 with the ram fully extended.

The space enclosed by the extensible wall 13 and the end faces 11 and 12 is divided into a plurality of compartments 15, as shown in FIGS. 2 and 3, by flexible diaphragms 16 which extend between opposed regions of the inner surface of the extensible wall 13, so as to be parallel with the end faces 11, 12. The diaphragms 16 are of waisted configuration, as shown in FIG. 4, so as to provide for communication between the compartments 15. When the ram is extended the diaphragms 16 constrain the extensible wall 13 to hold the shape desired, against lateral expansion by the ram inflation pressure.

The ram is packed in a retracted configuration (as shown in FIG. 1) by collapsing the extensible wall 13 inwardly between the diaphragms 16 to form a plurality of folds 17. Restraining means in the form of pairs of looped elastic cords 18*a*, 18*b*, 18*c*, 18*d* and 18*e* are attached to the dished plate 14, one of each pair of cords passing around an individual fold 17 in the upper part of the extensible wall 13 whilst the other cord of the pair passes around the corresponding fold 17 in the lower part of the extensible wall 13. These elastic cords restrain the folds 17 in the extensible wall 13 from movement away from the dished plate 14. The elastic cords are arranged so that the pair of cords 18*e* which pass around the folds 17 nearest to the dished plate 14 are located near to the bottom of these folds and close to the ram longitudinal centreline. The pairs of elastic cords 18*d*, 18*c*, 18*b* and 18*a* progressively diverge from the ram longitudinal centreline, the pair of cords 18*a* being furthest spaced therefrom. That portion of the extensible wall which is folded with the movable end face 12 is not restrained by an elastic cord.

In operation, in order to extend the ram 10, pressurised air from a suitable source, for example a pressurised air bottle (not shown), is introduced into the space enclosed by the extensible wall and the end face 11 and 12 through a suitable tapping (not shown) in the dished plate 14. This air passes through the spacings between the diaphragms 16 and the extensible wall 13 to inflate that compartment 15 which is spaced furthest from the dished plate 14, as is shown in FIG. 2, whereby the end face 12, being unrestrained by elastic cords, is moved away from the fixed end face 11 and applies load to an object (not shown) against which it is positioned. At this stage inflation of the other compartments is prevented by the restraining action of the elastic cords.

As the first compartment 15 to be inflated approaches its fully inflated shape the first fold 17 in the extensible wall is pulled out from under the first pair of elastic cords 18*a*. The second compartment 15 is now free to inflate and the pair of elastic cords 18*a* slip into a position alongside the next pair of elastic cords 18*b*, as shown in FIG. 3.

During inflation of the first compartment, most of the pressure energy of the inflating air is utilised to apply load. During inflation of subsequent compartments a portion of the pressure energy is employed to stiffen the extended length of the extensible wall so that it does not buckle, and the remaining pressure energy is used to apply load. The proportion of the pressure energy used to apply load varies in accordance with the extended length of the ram.

Each pair of elastic cords applies a restraining force to the fold 17 around which it passes, and also to all of the folds 17 between that fold and the end face 11 attached to the dished plate 14. Thus the elastic cords provide increasing restraint against inflation of successive compartments so that, as the ram extends, the compartments are inflated in sequence as the elastic cords are progressively overcome. This ensures that sufficient internal pressure to stabilise the already extended length of the ram wall 13 has to be developed in the ram before another compartment is released. The load applied to the packed compartments by the inflated compartments assists the restraint applied by the elastic cords.

As each fold is released for inflation of its associated compartment the pressure in the ram will drop until the unrestrained volume is recovered. However, as the fold of the next compartment to be inflated is subject not only to the restraining force of its own pair of elastic cords but also to the restraining forces of each of the pairs of elastic cords of the compartments already inflated and, also, the length of the fold to be pulled out from under the cords increases, a higher internal pressure is required to be developed to release the fold, so that the pressure drops experienced by the inflated length of the ram decrease progressively with each compartment released. As the last compartment inflates the cords will be pulled open until the last compartment is fully deployed.

It will be apparent to those skilled in the art that a ram in accordance with the present invention has a number of uses in applying load between its end faces to effect movement of objects such as, for example, the ejection of stores from confined spaces.

Of course, the embodiment hereinbefore described with reference to and as shown in the accompanying drawings is by way of example, and it will be appreciated that modifications may be made. For example, in a non-illustrated embodiment of an inflatable ram having an extensible wall which is arranged to collapse inwardly about each diaphragm to form a plurality of folds when the ram is retracted, the restraining effect is produced by elastic cords encircling the individual compartments between the diaphragms, the elastic cords being of progressively increasing restraining power from one end of the ram to the other.

In yet another similar non-illustrated embodiment, each compartment is restrained by burstable restraining cords or straps arranged circumferentially around the respective compartments and arranged to rupture at progressively increasing hoop stresses to produce the required sequential inflation of the compartments.

In a modification of the embodiment hereinbefore described with reference to the accompanying drawings, the movable end face co-operates with a rigid member forming a cover for the dished plate, the cover being secured to the dished plate by fastening means which are released by the action of the ram as it commences to extend.

I claim as my invention:

1. An inflatable ram having an extensible wall of flexible sheet material connecting two opposed end faces to enclose a space and permit the distance between the end faces to vary, the extensible wall being adapted to collapse in a plurality of folds laid one upon another when the ram is retracted, a plurality of diaphragms attached to and extending transversely of the extensible wall to divide the enclosed space into a series of interconnected compartments, and means tending to restrain each compartment against inflation comprising means adapted for cooperation with each fold to tend to restrain that part of the extensible wall within the fold against extension and whereby restraining forces applied to successive folds progressively increase from one end of the ram to the other so that in operation the ram extends by sequential inflation of the compartments from one end of the ram to the other as the restraining forces applied to the folds are progressively overcome by inflation pressure.

2. An inflatable ram as claimed in claim 1, wherein a separate restraining means is provided for each individual compartment.

3. An inflatable ram as claimed in claim 2, wherein the restraining means are of progressively increasing restraining power from one end of the ram to the other.

4. An inflatable ram as claimed in claim 2, wherein the restraining means are of equal restraining power and each restraining means is arranged to be active on each of the compartments between it and one end of the ram.

5. An inflatable ram as claimed in claim 1, wherein the flexible wall is arranged to collapse inwardly about each diaphragm to form a plurality of folds when the ram is retracted.

6. An inflatable ram as claimed in claim 1, wherein the restraining means comprise elastic cords.

7. An inflatable ram as claimed in claim 1, wherein an end face of the ram is attached to a rigid member.

8. An inflatable ram as claimed in claim 7, wherein the rigid member comprises a dished plate within which the extensible wall is housed when the ram is retracted.

* * * * *